US005344731A

United States Patent [19]

Deboer et al.

[11] Patent Number: 5,344,731

[45] Date of Patent: Sep. 6, 1994

[54] MIGRATION IMAGING SYSTEM

[75] Inventors: Charles D. Deboer, Rochester; Dennis R. Kamp, Spencerport; William Mey, Rochester, all of N.Y.

[73] Assignee: Eastman Kodak Company, Rochester, N.Y.

[21] Appl. No.: 915,683

[22] Filed: Jul. 23, 1992

Related U.S. Application Data

[63] Continuation-in-part of Ser. No. 632,698, Dec. 24, 1990, Pat. No. 5,138,388, which is a continuation-in-part of Ser. No. 621,691, Nov. 30, 1990, abandoned, and Ser. No. 673,509, Nov. 30, 1990, Pat. No. 5,227,265.

[51] Int. Cl.[5] ..... G03G 13/048; G03C 5/16

[52] U.S. Cl. ..... 430/41; 430/348; 430/130; 430/944; 250/317.1

[58] Field of Search ..... 430/41, 44, 126, 944, 430/348, 130; 250/316.1, 317.1, 318; 355/251

[56] References Cited

U.S. PATENT DOCUMENTS

| | | | |
|---|---|---|---|
| 3,410,203 | 11/1968 | Fischbeck | 101/1 |
| 3,574,657 | 4/1971 | Burnett | 117/8 |
| 3,723,113 | 3/1973 | Goffe | 96/1.2 |
| 3,798,030 | 3/1974 | Gundlach | 96/1 PS |
| 4,139,853 | 2/1979 | Ghekiere et al. | 346/1 |
| 4,148,057 | 4/1979 | Jesse | 358/4 |
| 4,252,890 | 2/1981 | Haas et al. | 430/292 |
| 4,536,458 | 8/1985 | Ng | 430/41 |
| 4,626,868 | 12/1986 | Tsai | 346/1.1 |
| 4,676,192 | 6/1987 | Yuge et al. | 355/251 |
| 4,711,834 | 12/1987 | Butters et al. | 430/201 |
| 4,883,731 | 11/1989 | Tam et al. | 430/41 |
| 4,937,163 | 6/1990 | Tan et al. . | |
| 4,942,110 | 7/1990 | Genovese et al. | 430/198 |
| 5,063,412 | 11/1991 | Hirsch | 355/251 |
| 5,227,265 | 7/1993 | De Boer et al. | 430/41 |

FOREIGN PATENT DOCUMENTS

| | | | |
|---|---|---|---|
| 344930 | 12/1989 | European Pat. Off. . | |
| 371011 | 5/1990 | European Pat. Off. . | |
| 430703 | 6/1991 | European Pat. Off. . | |
| WO88/04237 | 6/1988 | PCT Int'l Appl. | G03F 7/34 |

OTHER PUBLICATIONS

Printing by Beams of a Laser Beam by D. D. Roshon, Jr. & T. Young, vol. 7, No. 4, Aug. 1964, IBM Tech. Discl. Bull. p. 224.

Display Device Using Laser Beams by D. D. Roshon, Jr. & T. Young, vol. 7, No. 3, Aug. 1964, IBM Tech. Discl. Bull. p. 225.

Xeroprinting Master with Improved Contrast Potential by R. W. Gundlach, vol. 14, No. 4, Jul.-Aug. 1989; Xerox Discl. Journal, pp. 205-206.

*Primary Examiner*—Christopher D. Rodee

*Attorney, Agent, or Firm*—Leonard W. Treash, Jr.

[57] ABSTRACT

A migration imaging system using a laser-addressable thermoplastic imaging member 10. The imaging member 10 comprises a supporting section 15 and a thermoplastic imaging surface layer 14. A charged, uniform layer of marking particles 24 is deposited on the imaging surface layer 14. An imagewise-modulated laser beam 24 transforms selected volumes of the imaging surface layer 14 in an imagewise pattern to a permeable state. Charged marking particles 42 that overlay a transformed volume then migrate into the imaging surface layer 14, due to an electrostatic attraction to the imaging member 10, so as to be retained. Unaddressed marking particles 56 are cleaned away by particle removing device 20B comprised of a magnetic brush utilizing hard magnetic carrier particles. The imaging member 10, or solely the imaging surface layer 14, may be transferred and bonded to a receiver member such as a drum for use as an exposure mask in a xeroprinting process, or to a receiver sheet 64 to provide a hard copy reproduction. This migration imaging system provides an inexpensive method and apparatus for imaging which generates relatively little waste products.

1 Claim, 8 Drawing Sheets

MIGRATION IMAGING SYSTEM

This application is a continuation-in-part application of co-pending U.S. patent applications Ser. No. 07/632,698, filed Dec. 24, 1990 (now U.S. Pat. No. 5,138,388, issued Aug. 11, 1992); 07/621,691, filed Nov. 30, 1990 (now abandoned); and 07/673,509, filed Nov. 30, 1990 (now U.S. Pat. No. 5,227,265, issued Jul. 13, 1993).

BACKGROUND OF THE INVENTION

Field of the Invention

This invention relates generally to an imaging system, and specifically to an improved migration imaging system utilizing an imaging member having a thermoplastic imaging surface layer.

Description of the Prior Art

Within the art of electrophotography are imaging processes and system- which involve the migration of pigmented particles in a liquid or softenable medium to achieve an imagewise pattern or an image-receiving member. In electrophoretic and photoelectrophoretic recording systems, a liquid suspension of photoconductive particles disposed in a dielectric material between a pair of planar electrodes is imagewise exposed to actinic radiation. Exposed particles migrate to one electrode, and unexposed particles migrate to the other. In this manner, positive and negative images are produced on the respective electrodes. In mediums that are not liquid or permeable at room temperature, particle migration can be facilitated by the ,softening of the medium by the application of heat or solvents.

Another type of migration imaging system utilizes a solid migration imaging member which comprises a transparent conductive substrate, a layer of softenable material overlying the substrate, and a uniform layer of photoconductive marking material deposited atop the softenable layer. A latent image is formed on the particle layer by electrostatically charging this layer and then exposing it to an imagewise pattern of light to discharge selected portions of the layer. The entire softenable layer is then uniformly heated to render it permeable to the photoconductive particles on top of it. The non-exposed portions of the particle layer, i.e., those portions that retain a charge after the light exposure will migrate into the softened layer by electrostatic forces. One example of such an imaging process is disclosed in U.S. Pat. No. 4,883,731, issued to Tam et al. While this imaging system appears to be technically viable to overcome some of the problems associated with photoelectrophoresis. It is disadvantageous in that high power is required to soften the entire softenable layer. Moreover, it requires the use of photoconductive marking particles. Also, the images formed in the solid imaging members processed according to the foregoing approaches have been found to lack the image contrast, gray scale accuracy, and sharp resolution required in high-resolution image reproduction- A simpler and more efficient imaging system would be desirable.

In the published International Patent Application WO 88/04237, filed by Polaroid Corporation, there is disclosed a thermal imaging medium which includes a support sheet having a surface layer of a heat-liquifiable material and an overlying layer of a pigmented particulate or porous material. A pressure-sensitive adhesive layer overlies the particulate layer. The liquifiable material is imagewise exposed to heat to cause it to flow by capillary action into the particulate or porous layer. With cooling, the imaged areas of the substance are thereby retained by the particulate or porous material on the support sheet. The adhesive layer is then peeled away, causing the unexposed areas of the particulate layer to break from the exposed areas and be carried with the adhesive layer. The support sheet retains the exposed pattern.

A problem with the above process is that the fracturing between exposed and unexposed areas of the particulate layer can be uneven or irregular. Moreover, the heat-liquifiable material is expected to flow only into a certain volume of the pigmented particulate layer, but the flow is not restricted. The liquified material can flow laterally into a volume that is adjacent the heated area and which is not part of the image to be reproduced. The perimeter of an image component (a dot, for example) would be greater than intended. As a result, image quality can be degraded.

In general, prior art adhesive transfer and migration imaging systems are also materials-intensive and thus are costly to operate. This is especially so in systems which consume materials that are not provided in a simple, easy-to-use, and inexpensive form.

Significant waste products are generated in many of the above-described adhesive systems. Adhesive transfer systems generate discarded peel-away films which are usually not reusable. Proper disposal of such waste is inconvenient and increases operating costs.

Migration imaging and adhesive transfer processes have, therefore, not been favored for image reproduction in a number of applications, especially in high-resolution or high-speed printing systems.

SUMMARY OF THE INVENTION

In view of the foregoing discussion, an object of this invention is to provide a high resolution migration recording system which can operate at relatively low power, and which does not require photoconductive materials.

According to one embodiment of the invention, a uniform layer of charged marking particles, such as toner, is deposited on a thermoplastic imaging surface layer of an imaging member, such as by an electrically biased magnetic brush applicator. The thermoplastic imaging surface layer may be created by depositing a charged layer of thermoplastic particles, such as clear toner, on a conductive substrate. These particles are exposed to a diffuse source of heat causing the particles to melt together to form a thermoplastic imaging surface layer. When this layer is cooled, it will be generally supportive of the layer of marking particles. The marking particles are subject to an electrostatic attraction to the conductive substrate. The imaging member is selectively exposed to thermal energy, such as provided by a scanning infrared beam, in an imagewise pattern. The applied thermal energy transforms selected portions of the imaging surface layer underlying the charged marking particles to a permeable state.

Upon imagewise exposing the imaging surface layer, the charged marking particles that overlay the heated portions then migrate into the imaging surface layer, causing them to be retained by the imaging surface layer upon cooling. In some applications, the addressed particles are also tacked together due to the applied energy. Unaddressed marking particles are cleaned away by a magnetic brush cleaner utilizing hard magnetic carrier particles so as to provide a soft-touch cleaning action.

The imaging member produced by the above process may then be used as a hard copy image in the form of a reflection copy, a transparency, or as an image master. Alternatively, the imaging member may be attached at its imaging surface layer to a receiver sheet, such as a film sheet or paper sheet. In another embodiment, the thermoplastic imaging surface layer is separable from the imaging member and attachable to a receiver sheet.

A set of color separation images may be written on one ironing member. Such images may be written in series, and a set of hard copy color separations may be generated for use as, for example, color separation proofs. Alternatively, the color separations may be transferred in superposition to a single receiver to generate a composite color print.

An imaging system according to the invention is envisioned for use in direct digital color proofing, wherein near-photographic quality prints may be generated at higher speed and lower cost than by conventional methods such as thermal dye transfer. Pigments or ink particles to be used in the lithographic printing run may be used as the marking particles in generating a color proof. The resulting color proof has better color accuracy and therefore is more valuable than those provided by conventional processes.

The imaging member may be formed of simple materials that are inexpensive and easy to handle. No solvents are required and virtually no waste is generated in the imaging process. In fact, the unaddressed marking particles may be recycled for subsequent imaging.

The imaging member is especially compatible with a conventional laser scanner because the aforementioned selective exposure to heat-inducing energy may be provided by a scanning laser beam modulated by a rasterized data stream. Image information may be provided to the scanner and recorded in the thermoplastic imaging surface layer. The imaging member also may be thermally biased so as to reduce the amount of energy required to transform the imaging surface layer to a permeable state.

The imaging surface layer may be attached to papers that normally do not retain a toned image. Alternatively, the supporting section may be paper whereby no transfer of the processed-imaging surface layer is needed. Thus, hard copy reproductions may be produced on, or transferred to, a variety of papers or films that are not usable in the typical copier due to their weight, moisture content, surface layer texture or irregularity, electrical resistance, or other characteristics. The imaging surface layer, when transferred, also provides a more uniform gloss to the receiver.

One preferred application of the imaging member is in the production of high-quality hard copy images for the graphics arts industry and for diagnostic imaging equipment, such as ultrasonic, radiographic, and nuclear medical imaging devices. Such equipment is increasingly incorporated in large-scale digital picture-archiving and communication systems used in medical and other scientific research institutions.

In another preferred embodiment, the supporting section of the imaging member comprises a film base having photoconductive constituents. The imaging surface layer, after having an imagewise pattern of marking particles migrated therein, may be illuminated. Light not obscured by the marking particles will then discharge the film base in an imagewise pattern. The resulting latent image may then be developed and transferred to a receiver according to known xeroprinting methods.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings.

DETAILED DESCRIPTION OF THE PREFERRED EMBODIMENT

Figure 1A:
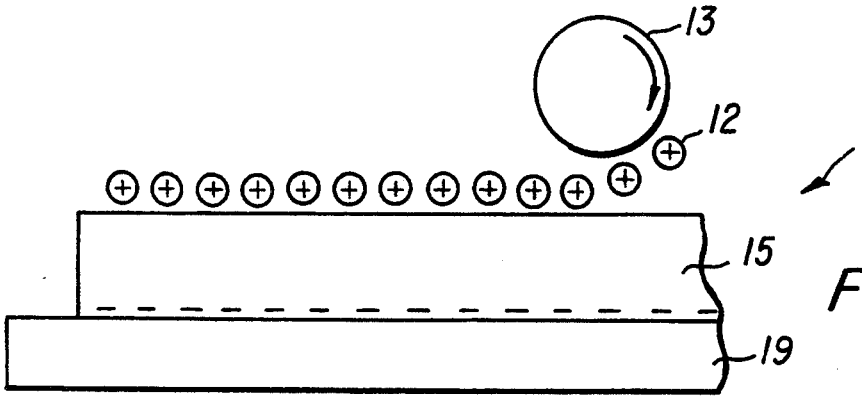
FIG. 1A is a side sectional view of an imaging member in the present invention, A supporting section on a support receives a layer of thermoplastic powder to be formed as a thermoplastic imaging surface in the thermoplastic imaging member.
Figure 1B:
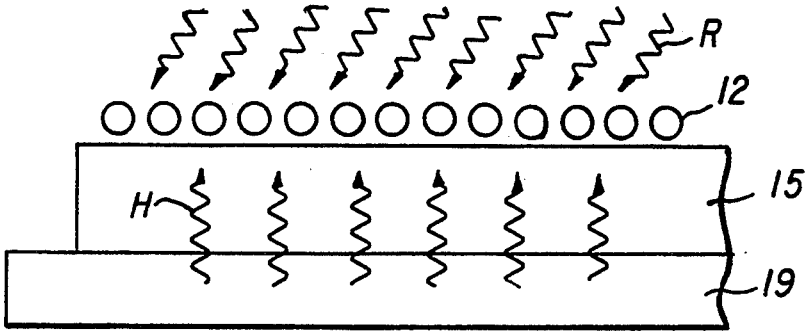
FIG. 1B is a side sectional view of the imaging member of FIG. 1A as the thermoplatic particle layer is heated to form the thermoplastic imaging surface.
Figure 1C:
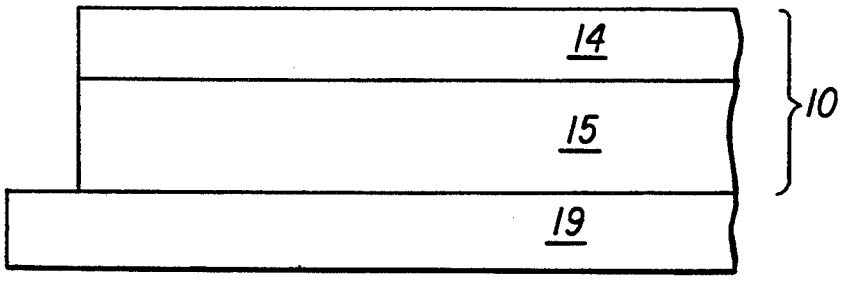
FIG. 1C is a side sectional view of the imaging member of FIG. 1B after the thermoplastic imaging surface has cooled.

As illustrated in FIGS. 1A–1C, a thermoplastic imaging member 10 may be prepared for use in a novel migration imaging system constructed according to the invention As shown in FIG. 1A, a supporting section 15 on a conductive support 19 receives a deposited layer of clear thermoplastic particles 12. The particles 12 my be deposited by use of a first particle deposition means 13 such as a magnetic brush charged with a quantity of thermoplastic particles, such as clear dry toner, mixed with magnetic carrier particles. It is also contemplated that in some applications the particles may be deposited directly on the support 19. For simplicity in the following description, the supporting section 15 will be included.

The thermoplastic particles 12 are composed of a thermoplatic material, preferably poly-iso-butyl-methacrylate (Elvacite 2045), which may be heated to effect a reversible transition from a nominally solid state to a plastic state. The thermoplastic material is preferably absorptive of heat-inducing radiation, such as infrared radiation, and accordingly, the thermoplastic material formulation my include an infrared-absorbing dye. The thermoplastic material is otherwise transparent with little absorption or scattering at other light frequencies.

As an alternative, when infrared absorption by the particles 12 is unfeasible, undesirable, or inappropriate for whatever reason, the supporting section 15 or the support 19 may be constructed from an infrared-absorptive material such that infrared radiation may pass through the particles 12 so as to heat the infrared absorptive component, Heat is then conducted to the particles 12.

As shown in FIGS. 1A and 1B, the clear thermoplastic particles 12 are uniformly heated by a momentary application of diffuse energy such that the particles melt and coalesce into a uniformly thick layer 14. Preferably, layer 14 is between 1 and 10 microns thick The diffuse energy may be infrared radiation R incident on the particles 12 or may be heat H conducted from heating elements (not shown) within the support 19 and supporting section 15. Other generalized heating apparatus are contemplated but not shown: infrared radiation from an infrared lamp, for example, may be directed from within the support 19 to the particles 12, if the support 19 is transmissive of such energy.

As shown in FIG. 1C, the uniform layer 14 upon cooling forms a smooth solid surface that is supportive of other particles for a novel imaging process to be described shortly. The layer 14 is therefore hereinafter termed a thermoplastic imaging surface 14. Furthermore, the combination of the thermoplatic imaging surface 14 and the supporting section 15 is considered an imaging member 10. For the purposes of illustration and clarity, the relative thickness of the imaging surface layer 14 and the supporting section 15 are not to scale. The imaging surface layer 14 is expected to be rather thin in comparison to that of the supporting section 15.

The thermoplastic imaging surface 14 may be transformed to a permeable state of heated beyond its transition temperature, and will then resolidify if allowed to cool below the transition temperature. It is contemplated that, at room temperature, the imaging surface 14 is solid, film-like, and largely undistinguishable from the remainder of the imaging member 10.

Figure 2:
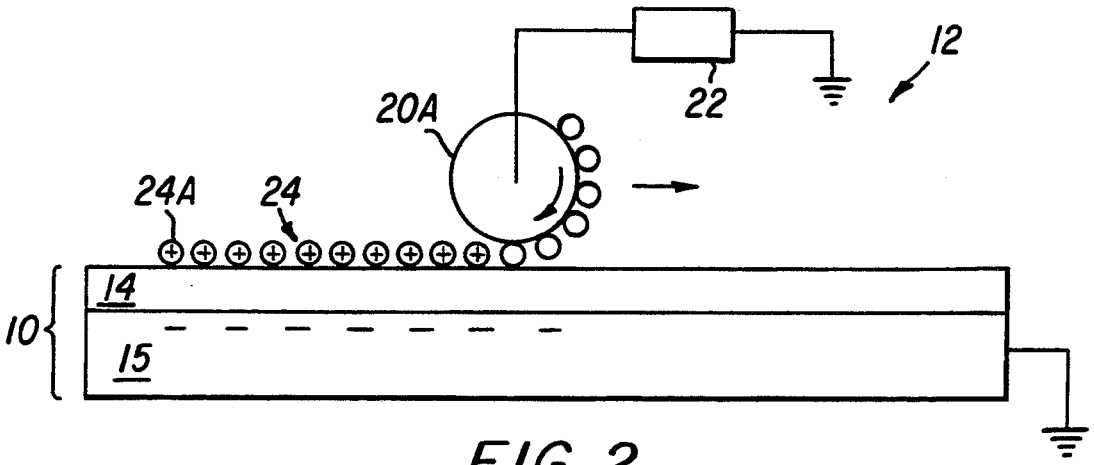
FIG. 2 is a side schematic view of a migration imaging system using the imaging member constructed according to FIGS. 1–3. The imaging member is illustrated during the step of deposition of marking particles on the imaging member.

As illustrated in FIGS. 2–4, the thermoplastic imaging member 10 is processed in a migration imaging system 12 constructed according to the invention. As shown in FIG. 2, the thermoplastic imaging surface layer 14 receives a marking particle layer 24 deposited by a particle deposition device 20A, such as a conventional magnetic brush applicator connected to a bias voltage supply 22. The particle deposition device 20A is supplied with a quantity of marking particles which are then deposited on the imaging surface layer 14 as the device 20A passes over the imaging surface 14. Although the marking particle layer 24 is illustrated for clarity as being a single layer of positively charged particles 24A, in practice, the layer is several particles deep. The polarities of the marking particle layer 24 and the supporting section 15 may in the alternative be reversed, depending upon the application.

Preferably, the marking particles 24A are dry pigmented thermoplastic particles often referred to as toner. A matrix of such toner particles are mixed with magnetic carrier particles to form a two-component developer usable by the magnetic brush. Preferably, the carrier particles have a diameter of 30 microns or less, and large surface areas to accommodate high marking particle concentrations. Preferably, the average particle size ratio of carrier to toner lies within the range of from about 15:1 to about 1:1.

During deposition of the marking particle layer 24, a conductive supporting section 15 of the imaging member 10 is electrically grounded so that an electrostatic field is established between the marking particles and the supporting section 15 according to known bias development techniques. Thus, marking particles are attracted to the imaging surface layer 14 by virtue of the electrostatic attraction of the individual particles to the supporting section 15. Alternatively, the marking particles may be first uniformly deposited and then charged by known techniques to cause them to be attracted to the imaging surface layer 14.

It is contemplated that other electrostatically-chargeable marking particles, such as dye particles, single-component developers, pigmented graphics art ink, or liquid toners may be uniformly deposited by other appropriate deposition means known in the art.

Referring to FIG. 1B, upon receiving a uniform layer of marking particles 24, the imaging member 10 is then imagewise exposed to heat-inducing energy. Preferably, such exposure is effected by a scanning, intensity-modulated light beam 42 provided by a beam scanner 40. The scanning beam 42, which in a particularly preferred embodiment is an infrared laser beam, may be directed from scanner 40 through either side of the imaging member 10 to one of several components of the imaging member 10. For example, when substrate 15 comprises a material which at least partially absorbs IR radiation (e.g., KODAK ESTAR $_{TM}$ film base having carbon dispersed in it), the beam 42 may be focussed through the rear surface 16 of supporting section 15 to heat the supporting section. Alternatively, when substrate 15 is transparent to IR radiation (e.g., KODAK ESTAR $_{TM}$ film base), the beam may be focused at the thermoplastic layer 14. Alternatively, the beam 42 may be focused directly onto the marking particle layer 24 whereupon the exposed particles absorb the incident radiation and are heated, and whereupon the heat so generated is conducted to the underlying thermoplastic layer 14. Finally, the beam 42 may be directed through the marking particle layer 24 to heat the thermoplastic layer 14 if the marking particles in layer 24 are substantially non-absorptive of the scanning beam.

Those skilled in the art will recognize that the selection of the beam focal point is determined according to several factors such as the wavelength of the incident beam and the materials that constitute the imaging member 10 and the particle layer 24. Many formulations of non-carbon toner, for example, are non-absorptive at infrared wavelengths. Whether the focal point is selected as being in the supporting section 15, the imaging surface layer 14, or the marking particle layer 24, the object of the exposure is to selectively establish (by direct radiation or by conduction) an intensive mount of heat within a minute volume, or pixel 25, of the imaging surface layer 14 as to allow migration of the marking particles into the thermoplastic layer 14.

The beam 42, in addition to being intensity-modulated according to the image data to be recorded, is also line-scanned across the imaging member. The exposure to thermal radiation heats a succession of pixels 25 in the imaging member 10. As each pixel is exposed or "addressed", there is a localized change in state, or transformation, of the exposed portion of the imaging surface layer 14. That is, the imaging surface layer becomes selectively permeable or softened by the superposed marking particles 54, according to the mount and location of the heat that it receives.

The marking particles 54 that overlie a transformed pixel portion of the imaging layer 14 will migrate into the imaging surface layer 14 under the influence of their electrostatic attraction to the supporting section 15. In applications which use thermoplastic marking particles, the induced heating will be sufficient to also tack the addressed particles 54 together. The pixel exposure is sufficiently brief that the migrating marking particles 54 soon harden into a coherent group, and the transformed volume portion of the imaging layer regains a substantially non-permeable state. Adjacent, unaddressed marking particles remain undisturbed on the imaging surface layer 14.

Relative movement between the beam 42 and the imaging member 10 in the cross-scan direction provides a full image frame exposure. In the illustrated embodiment, the particle deposition device 0A is moved relative to the imaging member 10 (see FIG. 1). The scanning beam 42 may be advanced in the cross-scan direction such that the scanning beam "trails" the particle deposition device 20A as an advancing edge of the marking particle layer 24 is deposited. Alternatively, the imaging member 10 may be moved past a stationary particle deposition device 20A; the scanning beam 42 then does not necessarily include a cross-scan motion component.

Other variations of the above sequence are contemplated; for example, the imaging surface layer 14 may be fully toned before scanning is initiated. Or, in an alternative to the beam scanning exposure in the above, an image frame may be exposed by contact mask exposure of the image member 10 to heat-inducing energy selectively passed through a fixed linear or a real mask. Methods for effecting such mask exposure are known in the art.

As illustrated in FIG. 1C, the image frame is then rid of the unaddressed marking particles 56 by a particle-removing device 20B, leaving behind only the addressed particles 54 on or in the imaging surface layer 14. Device 20B preferably comprises a magnetic brush that is charged with magnetic carrier particles only, i.e., it is substantially free of toner particles. Preferably, the marking particle deposition and removal steps are performed by a single magnetic brush which incorporates a mechanism for controlling the concentration of marking particles therein. Alternatively, two magnetic brushes may be used, one being charged with a mixture of marking and carrier particles (for deposition) and the other being charged only with carrier particles (for toner removal).

Figure 3A:
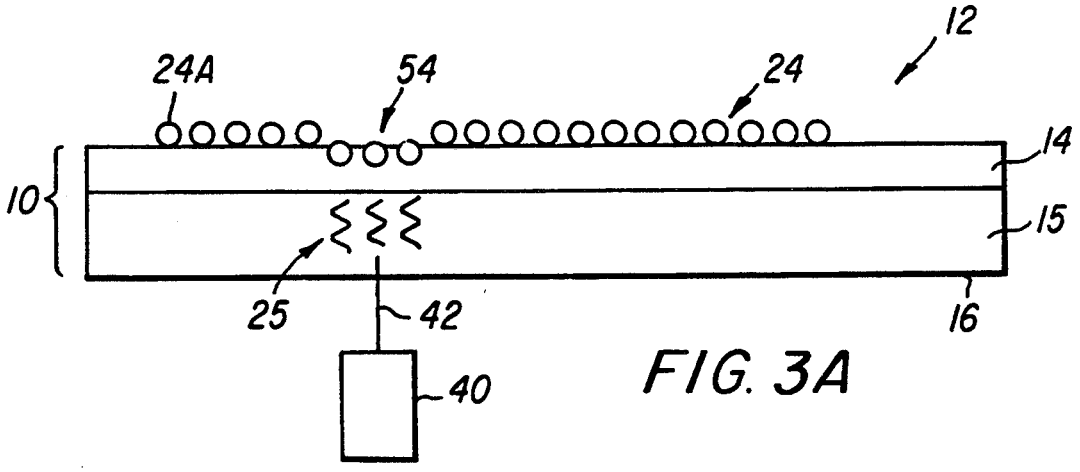
FIGS. 3A and 3B are side schematic views of the imaging system of FIG. 2 during the steps of imagewise exposure and cleaning, respectively, of the thermoplastic imaging surface layer on the imaging member.
Figure 3B:
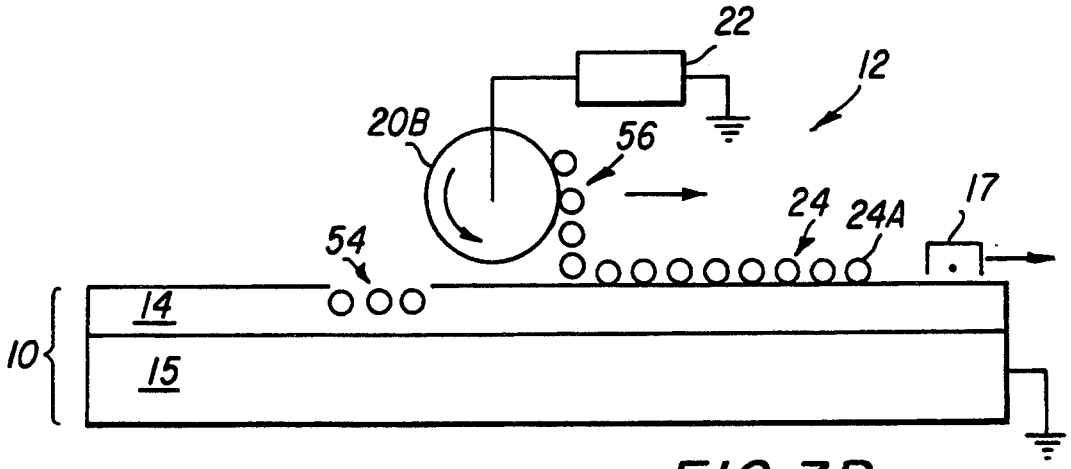

In another embodiment of the invention, the above-described step of uniform heating of the particles 12, to cause them to coalesce and then cool into an imaging surface layer, my be omitted. Instead, the thermoplastic particles are undisturbed and remain in the particulate state. The marking particle layer 24 is then deposited over the thermoplastic particles. The result, then is two particulate layers on the supporting section 15, although mixture of the two layers is permissible. Processing of the imaging member then proceeds as illustrated in FIG. 3A, with selective exposure of the superimposed particulate layers to heal The heat-induced transformation of the thermoplastic particles 12 then allows the addressed marking particles to migrate and coalesce with the respectively-addressed thermoplastic particles. The processing of the imaging member 10 then proceeds as was described with reference to FIG. 3B, with the exception that both the unaddressed thermoplastic particles and the unaddressed marking particles are cleaned from the supporting section 15. The addressed particles cool to a solid state and remain on (are attached to) the supporting section in an imagewise pattern.

Figure 14:
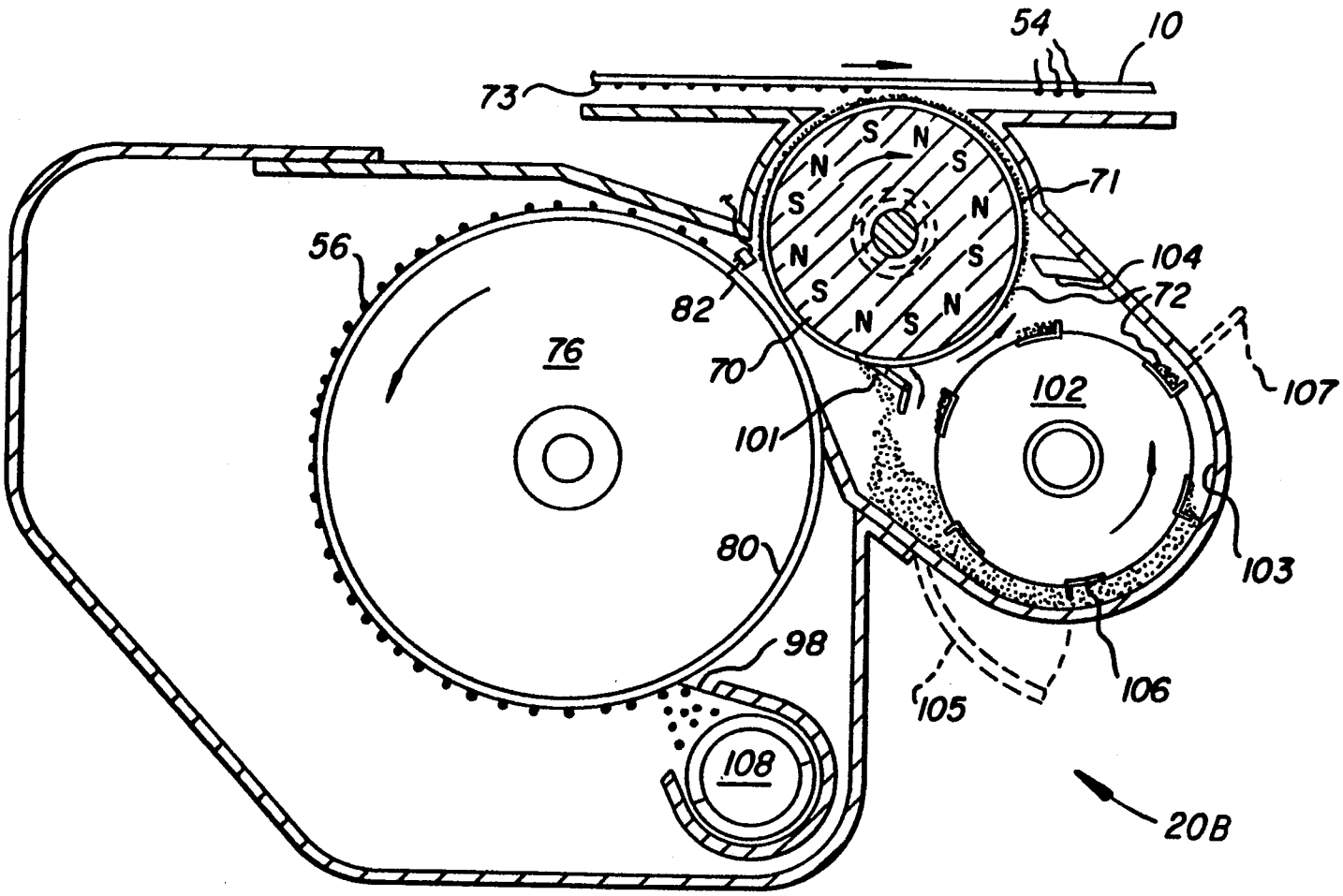
FIG. 14 is a view of the particle removing device of the instant invention.

With reference now to FIG. 14, a preferred embodiment of the particle-removing device 20B will be described. Such a device includes a rotatable magnetic core 70 driven in, for example, a clockwise direction, preferably at a speed of between 800 and 2500 rpm. An outer cylindrical shell 71 is driven in a counterclockwise direction, preferably at a speed of between 50 and 150 rpm. The shell 71 is formed of a non-magnetic material; e.g., chrome, brass, aluminum, copper or stainless steel or a composite comprising a nonconductor, such as fiberglass, plated with one of the aforementioned materials. Conventional means (not shown) are provided for rotating the core and the shell in the requisite counter-current directions. The directions of the imaging member 10, the core 70, and shell 71 may all be reversed, depending on the application. The shell 71 is closely spaced to the imaging member 10 so that a nap formed by aligned magnetic carrier particles can fill the small gap or nip region between the imaging member 10 and the shell. As explained below, it is highly preferred that the carrier particles be magnetically "hard" so that they tend to flip-flop in the charging magnetic field produced by the rotating core piece 70, and thereby provide a very gentle touch to imaging member 10.

The magnetic core 70 comprises magnetic poles N and S integrated within the periphery of the core and adapted to rotate clockwise as a unit so that the aforementioned nap comprises chains of the hard magnetic carrier particles 72 on the periphery of the shell. By virtue of the changing polarity of the magnetic fields from the core, the carrier particle chains are sufficiently active in a tumbling action to remove substantially all of the unexposed marking particles 56 from the imaging member 10 without substantial removal of the exposed marking particles 54. The core is adapted to rotate in either direction, although preferably it rotates clockwise. The preferred combination of directions of the core and shell is that which causes a flow of tumbling carrier chains in a direction counter-current to the movement of the imaging member 10.

Specifically, it is believed that upon entering the aforementioned nip region, the marking particle layer 24 is bombarded by the tumbling chains of carrier particles 72. This bombardment has a significantly tangential component (with respect to the web surface) and the momentum mechanically exceeds the marking particle-to-imaging member contact force of the unexposed marking particles 56, thus allowing the electrostatic field (between the conductive supporting section 15 and a properly biased surface of the magnetic brush shell 71) to dominate. The unexposed marking particles 56 migrate away from the imaging member 10 into the cloud of tumbling carrier particles on the shell 71. The exposed particles 54 remain on the imaging member 10 due to their greater adhesion. Triboelectric charging also causes the unexposed marking particles 56 to be attracted to, and adhere to, the rapidly moving carrier particles 72, thus providing for transport of these marking particles out of the nip region.

To aid the removal of the unexposed marking particles 56 from the imaging member, an AC corona charging station 17 (cf. FIG. 3) located upstream of particle removing device 20B may be operated to neutralize any charge remaining on imaging member 10 and thus reduce the binding force of the unexposed marking particles 56 to imaging member 10. As a result of this treatment, the marking particles may be biased slightly electrically positive. In addition, a source of bias voltage (not shown) may be coupled to the shed 71 to bias same negatively to electrostatically attract the positively charged marking particles toward the shell.

Means for detoning the steadily-collected marking particles from the carrier particles must be provided. Failure to do this will result in the system's inability to operate in a continuous mode. This detoning process can be accomplished by placing an electrically biased, rotating detone roller 76 in engaged contact with the carrier chains formed on the rotating shell 71. By placing a sufficiently high electrostatic surface potential on the detone roller, an electric field is established between shed 71 and detone roller 76. The resulting electrostatic forces can be controlled so as to strip the collected marking particles from the carrier particles 72 and cause them to deposit on the surface of the detoning roller 76.

For example, the surface of detoning roller 76 may be formed from a non-magnetic conductive material such as aluminum or a composite such as fiberglass that is plated with a metal conductor. One or more electrical brushes 82 are provided as shown and connected to a bias voltage source. The electrical brush 82 engages the surface of the detoning roller 76 to establish a bias thereon such that the potential on the detoning roller causes the collected marking particles to migrate across the gap between the magnetic brush 70 to adhere to the detoning roller 76. The surfaces of the detoning roller and the shell may be rotating either co-current or counter-current to each other. The carrier particles 72 may be recirculated, whereas the unexposed marking particles 56 are subsequently removed from the rotating detoning roller by a contact side 98 and are transported to a collection site by collection device 108.

Located generally on the opposite side of the detoning roller, collection device 108 for marking particle collection may include a suitable apparatus for recirculating marking particles back to particle deposition device 20A. Particle collection and recirculating apparatus are well known in the prior art; for example, see U.S. Pat. No. 3,788,454. In lieu of recirculating the marking particles, a container may be provided for collecting marking particles from the chamber.

A skiving blade 101 is also engaged with the magnetic brush shell 71 to remove carrier particles 72 and any marking particles not stripped from the shell 71 by the detoning roller. A metering skive 104 is provided spaced from the periphery of the brush shell 71 to smooth and control the thickness of the carrier particles on the brush. Any marking particles and carrier material removed by skiving blade 101 will fall into a carrier mixture chamber 103 which is continuously mixed by suitable rotating mixing paddles (not shown) formed in the interior of carrier transport wheel 102. The wheel 102 comprises an open structure permitting hard magnetic carrier particles 72 to enter the inside portion thereof and to be worked back and forth by the mixing paddles located on the inside of the wheel 102 so that mixing occurs as the wheel is rotated. The wheel 102 also includes a series of trays 106 located on its periphery to carry hard magnetic carrier particles 72 toward shell 71. The hard magnetic carrier particles 72 are attracted to the shell 71 and collect thereon for movement toward the nip formed between the shell and the imaging member 10.

Periodically, a carrier purge door 105 may be opened to remove the used carrier particles. A fresh supply of carrier particles may be introduced through a carrier loading door 107. Since any marking particles falling within the carrier mixture chamber can be subsequently picked up by the magnetic brush and eventually reach the collecting chamber, it comprises a potential source of contamination. Therefore, the frequency of change of the carrier particles 72 should be adjusted to keep contamination to an acceptable level.

Figure 15:
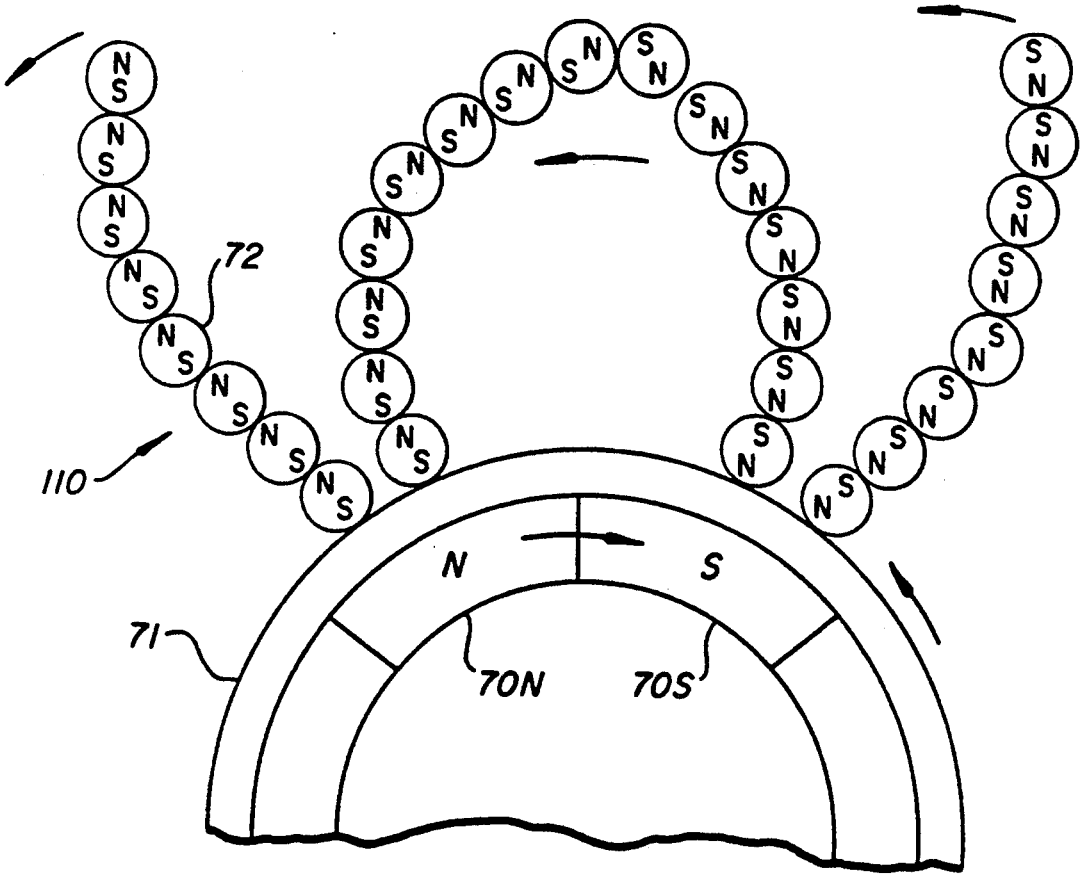
FIG. 15 is a view of the tumbling action of the carriers particles used in the particle removing device of the instant invention.

Turning now to FIG. 15, the characteristics of the preferred composition for the carrier particles 72 used in the particle removing device 20B of FIG. 14 will be described. First, the distinction between soft and hard magnetic materials must be understood. Soft magnetic carrier particles have been the preferred material in conventional magnetic brush systems. Such magnetic carrier is formed of relatively soft magnetic material (e.g. magnetic pure iron, ferrite or a form of $Fe_3O_4$) having a magnetic coercivity, $H_e$, of about 100 oersteds or less. Such soft magnetic materials have been used because they inherently exhibit a low magnetic remanence, $B_R$ (e.g. less than about 5 EMU/gm) and a high induced magnetic moment in the field applied by the typical brush core.

Soft magnetic carrier particles having a low magnetic remanence retain only a small mount of the magnetic moment induced by a magnetic field after being removed from such field. Such materials are readily transported by the rotating brush and are prevented from being picked up by the imaging member during development. However, soft magnetic carrier particles tend to form in undesirable radially-segmented layers that are parallel to the direction of magnet rotation. These layers tend to be more prominent where there is resistance to flow, in areas such as the cleaning zone of a magnetic brush cleaner. Furthermore, and most importantly, carrier particles formed from soft magnetic material will not exhibit the tumbling action that is necessary to, and characteristic of, particle-removing device 20B. Soft carrier particles will internally switch their magnetic alignment without physically moving or tumbling.

Soft carrier particles have been preferred for cleaning brushes because of the aggressive scrubbing action they provide. Heretofore, hard carrier particles have been considered unsuitable for use in a cleaning station because the "soft" touch it provides is unsuitable for cleaning. But, in the present application, a "soft" touch is needed to distinguish between the exposed toner particles and the unexposed toner particles.

It is important to note, therefore, that the carrier particles 72 used in the present invention are formed of hard magnetic material. The preferred carrier particles 72 are formed of hard magnetic material that has a high coercivity and resists internal realignment. For the purposes of this description, the term hard magnetic material refers to materials having a coercivity greater than 200 oersteds. Accordingly, the carrier particles used in particle removing device 20B may be composed substantially the same as the hard magnetic carrier particles used in the particle deposition device 20A (cf. FIG. 1). Strontium and barium ferrite are two examples of a preferred material from which to make the hard magnetic carrier particles. One advantage of using a single composition of carrier particles in both the particle deposition device 20A and the particle removing device 20B is that cross-contamination of carrier particles is avoided.

With reference now to FIG. 15, the desired tumbling action afforded by the preferred hard magnetic carrier particles 72 will be understood. Chains 110 of aligned, hard magnetic particles 72 will form outwardly from the surface of the shell 71. This alignment of the particles is caused by the magnetic fields generated by the magnets 70N and 70S that are located directly below the particulate chains.

As the magnets rotate, the particulate chains 110 try to move in the same direction. If the surface of the shell 71 was frictionless, the chains 110 would follow the rotating magnets. As the shell is not perfectly smooth, friction causes the chains 110 of particles to lag behind the moving magnets. As an opposing polarity magnetic pole N or S approaches the bottom of any one chain, there is a repulsive force between the oncoming pole and the bottom of the chain. At the same time, there is an attractive force between the top of the chain and the oncoming pole. This combined repulsion and attraction causes the chain to tumble. Accordingly, a large number of such particulate chains are forced to tumble as the magnets 70N and 70S in the core rotate.

The particle removing device 20B thereby removes unexposed marking particles from the imaging member by this vigorous tumbling motion of the magnetic carrier particle chains 110 that are transported around the circumference of shell 71. Each tumble is accompanied by a rapid movement of the particle around the shell in a direction opposite to the relative movement between the shell and core. The observed result is that the carrier particles thereby flow smoothly past the imaging member surface at a rapid rate.

The tumbling action of the carrier particle chains removes marking particles from the imaging member without incurring the significant abrasion caused by conventional magnetic and non-magnetic brush cleaners. The arrangement of carrier particle chains provides for a much shorter radius of carrier particles than the prior art magnetic brush cleaners, and is very much shorter than the brush strands that extend radially from a fiber bush cleaner. Also, the majority of the momentum of the carrier particles in the present invention is tangential to the imaging member, to thereby loosen the marking particles without causing the significant impact on the imaging member surface that is common to the prior art. These factors provide for effective, gentle cleaning without causing abrasion of the imaging member. The tumbling action provides a high flow rate of carrier particles past the imaging member surface. The improved flow rate contributes to the effectiveness of the gentle cleaning action.

Thus, the carrier particles that enter the region of contact (i.e., the cleaning zone) between the magnetic brush and the imaging member will collide with the marking particles on the imaging member. However, the force of this impact is sufficiently non-aggressive such that the binding forces holding the exposed marking particles to the imaging member are not overcome. Control of the carrier height and flow rate, and thus control of the tangential momentum of the carrier particles, can provide the desired differential of cleaning effected by particle removing device 20B. The contemplated tumbling action of the carrier particle chains can therefore be optimized to remove only the unexposed marking particles from the imaging member without removing any significant amounts of exposed marking particles. Proper formulation of the carrier particles 72 will contribute to the enhanced cleaning capabilities of particle removing device 20B.

Carrier particle flow rate in the contemplated cleaning apparatus is dependent not only on coercive force but also on the moment induced by the magnetic poles N or S in the magnetic core 70. In choosing between materials with a known coercive force, the material with a higher induced moment or initial permeability is preferred because such materials have been found to How at a higher rate. Preferably, one would select materials having an induced magnetic moment of at least 20 EMU/gm when in an external magnetic field of 1000 gauss. Also, hard magnetic material may be used that has been exposed to a high external magnetic field and thus is permanently magnetized. Such a material, after being permanently magnetized, will have a higher induced moment at 1000 gauss.

The carrier particles may be binderless carriers (i.e., carrier particles that contain no binder or matrix material) or composite carriers (i.e. carrier particles that contain a plurality of magnetic material particles dispersed in a binder). Both binderless and composite carrier particles containing magnetic materials are available to comply with the 200 oersteds minimum saturated coercivity level so as to be usable as hard magnetic carrier particles.

The unaddressed marking particles 56 need not be wasted and in fact are reusable. Unaddressed marking particles lifted by the cleaning process are carried by the particle removing device 20B to be ejected into a receptacle for re-use in a future marking particle deposition step. If the marking particle deposition and cleaning steps are performed by a single device, the device may be suitably prepared to deposit marking particles and then be automatically altered in such a way that particles are attracted by the device. For example, a reversal of the biasing field in a magnetic brush is one such alteration.

Thus, to recount the processing steps shown in FIGS. 1–3, after the marking deposition step, the particle deposition device 20A may be withdrawn from the imaging member, scanning exposure is done, and particle removing device 20B is passed over the image frame to remove unaddressed particles 56. The aforementioned steps may be conducted sequentially over one or more image frames. Alternatively, it is contemplated that first, second, and third areas of one image frame may be respectively and simultaneously undergoing the deposition, exposure, and cleaning steps.

In one preferred embodiment, the thermoplastic layer 14 of imaging member 10 is transparent and strippable from the underlying substrate 15 so that with little or no further processing, the thermoplastic layer may be removed from the substrate and used as an image transparency or image mask. The pattern of migrated particles forms an image viewable by projection in a fashion similar to that used with a conventional image transparency. The pattern of migrated particles also forms a negative or positive exposure mask usable in the exposure of, for instance, a photosensitive film: web, or printing plate. For example, the image member may be positioned adjacent a charged photoconductor and used as a master image for contact exposure of the photoconductor in an electrostatographic imaging process.

Figure 4A:
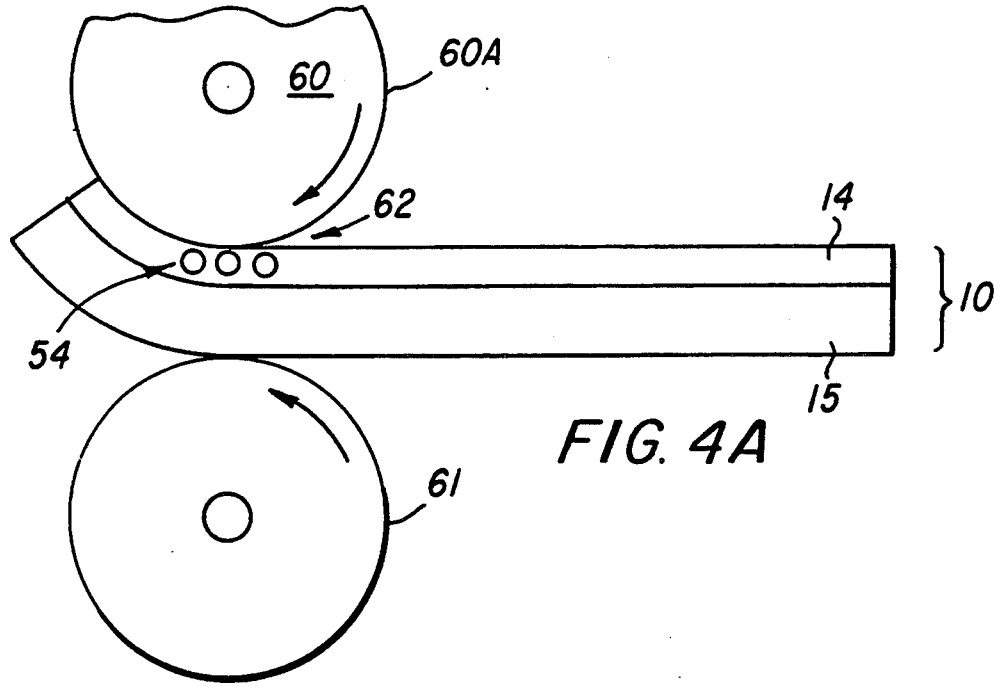
FIG. 4A is a side schematic view of the imaging member of FIG. 2 during transfer of the imaging member to a receiver means.
Figure 4B:
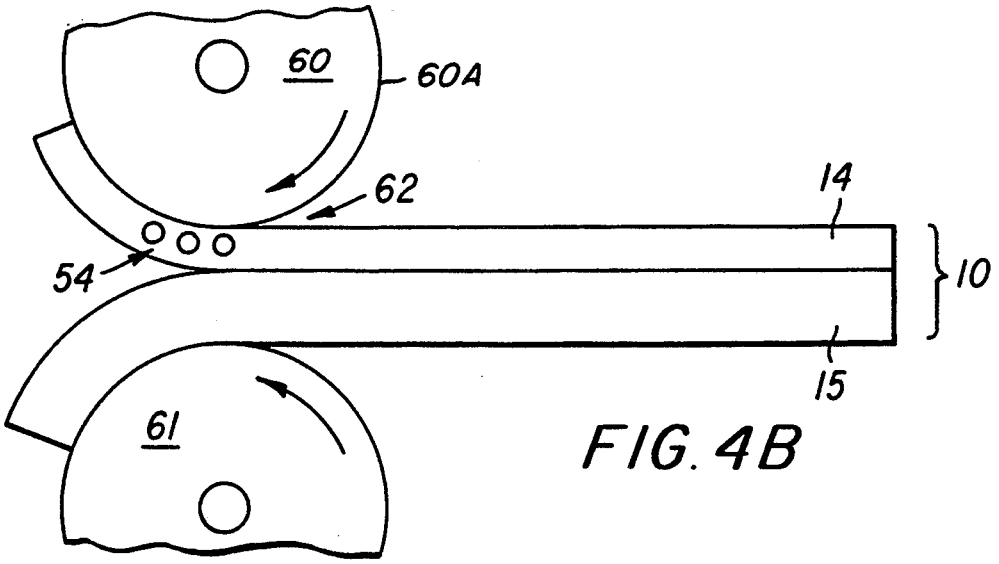
FIGS. 4B and 4C are side schematic views of the imaging member of FIG. 2 during transfer of the thermoplastic imaging surface layer from the image member to receiver means or a receiver sheet, respectively.
Figure 4C:
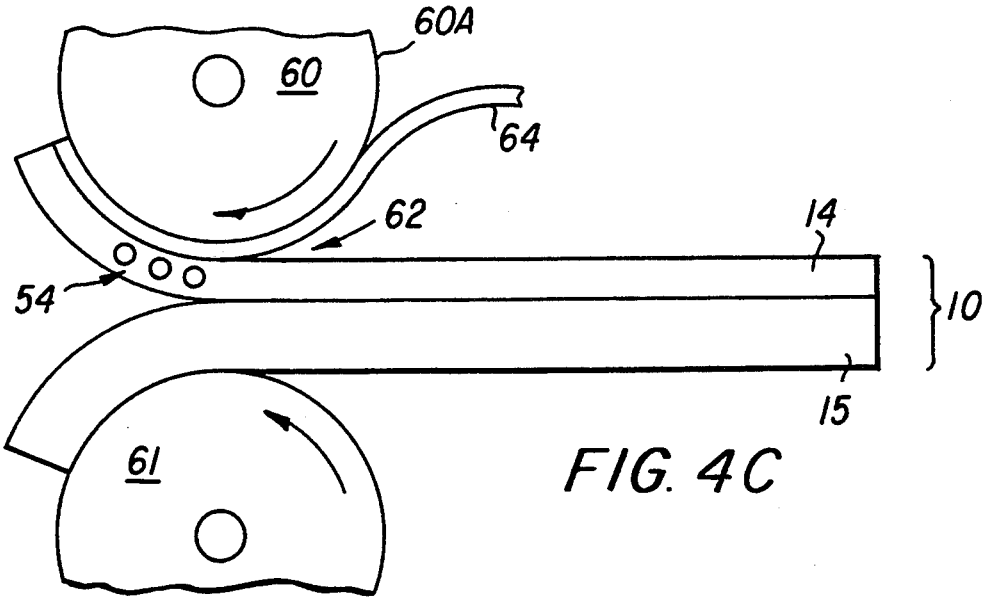
Figure 4D:
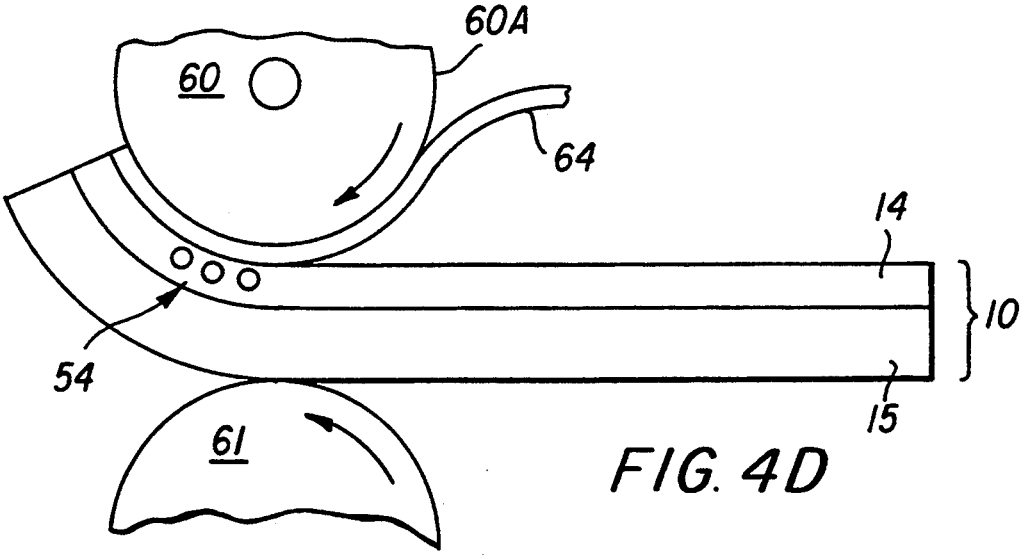
FIG. 4D is a side schematic view of the imaging member of FIG. 2 during transfer of the imaging member to a receiver sheet.

As illustrated in FIGS. 4A–4D, the practice of the invention my continue with additional processing such that the thermoplastic imaging surface layer 14 is bonded to a receiver. Preferably, suitable receivers include receiver 60, such as a rotatable drum as shown in FIGS. 4A and 4B, or a receiver sheet 64 as shown in FIGS. 4G and 4D.

As shown in FIG. 4A, the surface 60A of receiver 60 progressively contacts a section 62 of the thermoplastic imaging surface layer 14. Section 62 is heated by, for example, selective energization of heating elements (not shown) within the receiver 60 or pressure roller 61. In contrast to the aforementioned selective exposure to heat-inducing energy shown in FIG. 2, the heat applied in this transfer step effects an overall softening of the interface between the imaging surface layer 14 and the receiver 60 such that the surface 14 adheres to the receiving surface The step of bonding the entire imaging member 10 to a transparent version of the receiver 60 is desirable in that the receiver 60 so equipped is usable as a master in xeroprinting, mask exposure of printing plates, or other projection-based imaging processes. Accordingly, planar versions of receiver 60 are also contemplated, such as a planographic plate.

Alternatively, as illustrated in FIG. 4C, a receiver sheet 64 is introduced at the contact point 62 to receive the imaging surface 14. The receiver sheet 64 may be a sheet of, for example, photoconductive material, paper, or transparent film stock. The receiver sheet 64 may be predisposed and retained on the receiver means 60 by known sheet-holding means, such as vacuum orifices, until release is necessary.

In the embodiments shown in FIGS. 4B and 4C, the imaging surface layer 14 is softened in the generalized heating step such that it also separates at the contact point 62 from the supporting section 15. Only the imaging surface layer 14 then bonds to the receiver sheet 64 or to the receiver 60. The supporting section 15 may be removed and discarded or, preferably, set aside for recoating with a new thermoplastic imaging surface layer 14. Thus, the supporting section is reusable.

Known apparatus (not shown) may operate on the imaging surface layer after the cleaning step (illustrated in FIG. 3) so as to fix the addressed marking particles in the image surface. Or, a fixing step may be especially useful in applications where, for example, the imaging surface layer 14 is completely separated and bonded to the receiver 60 or sheet 64. The receiver sheet 64 may, for exhale, be a paper sheet stripped from the receiver 60 and then optionally guided to a fusing station, etc. for further processing of the imaging surface layer. The sheet 64 is then usable as a hard copy reproduction of the image information that modulated the scanning beam 42 in FIG. 2.

Alternatively, as illustrated in FIG. 4D, the supporting section 15 is not separated from the imaging surface layer. The receiver sheet 64 thereby acquires not only the imaging surface layer 14 but also the particular attributes or characteristics of the supporting section 15. One preferred attribute is abrasion resistance, as my be provided by a supporting section composed of transparent plastic film. Other examples of increased functionality are greater conductivity or resistivity respectively provided by a metallized or insulating section; or rigidity, thermal stability, and other attributes afforded by materials selectable from the known art.

Figure 5:
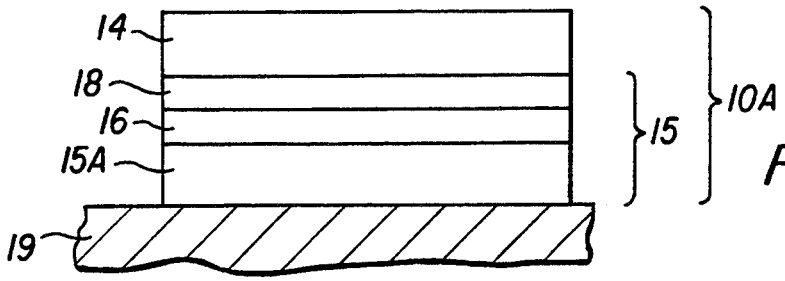
FIG. 5 is a side sectional view, in greater detail, of the imaging member of FIG. 2 on a support.
Figure 6:
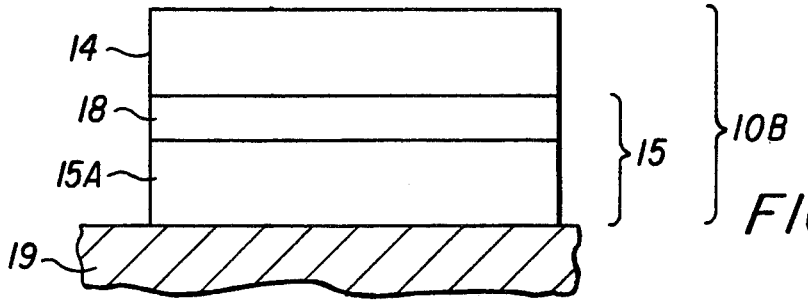
FIG. 6 is a side sectional view of an alternative embodiment of the imaging member of FIG. 5.

With reference to FIGS. 5 and 6, one may now appreciate that according to the invention, the imaging surface layer 14 is composed of a thermoplastic material that may be heated to effect a reversible transition from a state supportive of marking particles to a state permeable by marking particles. The thermoplastic material is thus transformable to a permeable state if heated beyond its glass transition temperature, but will resolidify if allowed to cool below the glass transition temperature. The thermoplastic material my be selected for its absorptivity of infrared radiation, e.g., its formulation may include an infrared-absorbing dye in an Elvacite 2045 binder, whereupon an applied beam of infrared radiation will cause localized heating. The imaging surface layer 14 is otherwise transparent with little absorption or scattering at other light frequencies.

At room temperature the imaging member 10 is preferably flexible and film-like. Accordingly, the supporting section 15 is preferably composed of a flexible dielectric material that is dimensionally and thermally stable, such as plastic film or paper. For some applications, the supporting section would be composed of a material which allows optical transmission of light without inducing significant aberration. Some plastic film base materials are known for such use; one suitable formulation is KODAK ESTAR $_{TM}$ film base available from Eastman Kodak Company. In other applications, for example in lithography, the supporting section may take the form of a non-transparent, rigid plate.

Two embodiments of the imaging member 10 will further exemplify the invention. In the imaging member 10A of FIG. 5, the supporting section 15 is composed of a transparent film base 15A having a transparent conductive electrode layer 16 and an optional release layer 18. The imaging member 10A may be positioned on a support 19. In various applications the support 19 may be in the form of a drum, web, or plate that is optically transparent.

The electrode layer 16 is a thin, uniformly conductive coating on the film base 15A applied by processes known in the art. The layer 16 is preferably a transparent layer that is connectable to ground. An electrostatic potential may thus be established between the marking particle layer 24 and the electrode layer 16.

The release layer 18 is composed of a known material usable for enhancing the aforementioned separation of the imaging surface layer 14 from the support 15. Such a material may be a polycrystalline wax, for example. The imaging surface layer 14 may be formulated such that it is separable from the supporting section 15 without such a release layer. If the imaging member 10 as a whole is to be transferred from support 19 to the receiver 60 or sheet 64, the release layer 18 can be omitted.

The imaging surface layer 14 need not be formulated to be non-absorptive of infrared radiation- Another component (such as marking particle layer 24, the conductive layer 18, the film base 15A, or the support 19) is then formulated to be infrared-absorptive, such that the scanning beam 42 will cause localized heating in the respectively absorbent medium or layer. Heat is thereby, conducted from such medium or layer to the imaging surface layer 14 to cause the aforementioned transition to the permeable state.

The imaging surface layer 14 may be uniformly thermally-biased by heating elements (not shown) in the support 19 to a temperature slightly below its glass transition temperature. Only a relatively small mount of localized heat is then required to effect the localized transition of the thermoplastic material to the permeable state that was described with respect to FIG. 2. Thermal biasing can also be used to aid the separation of the imaging surface layer 14 from the imaging member 10 that was described with respect to FIG. 4B.

As shown in FIG. 6, imaging member 10B is preferred for use in applications wherein the imaging member is supported by a conductive support 19, such as a metallic drum. The electrode layer 16 (see FIG. 5) is omitted, and connections otherwise made to the electrode layer 16 are made to the support 19.

Figure 7:
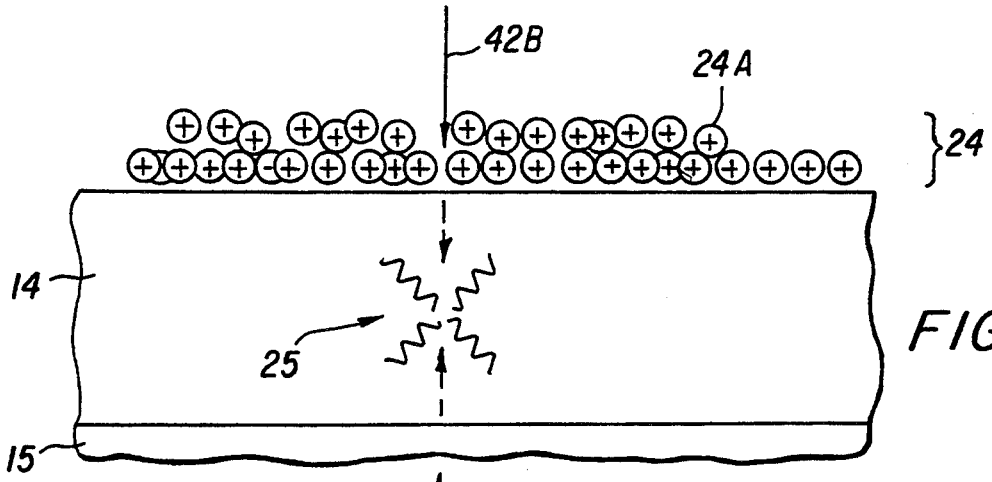
FIG. 7 is a side sectional view, in greater detail, of the exposed portion of the imaging member of FIG. 2.
Figure 8:
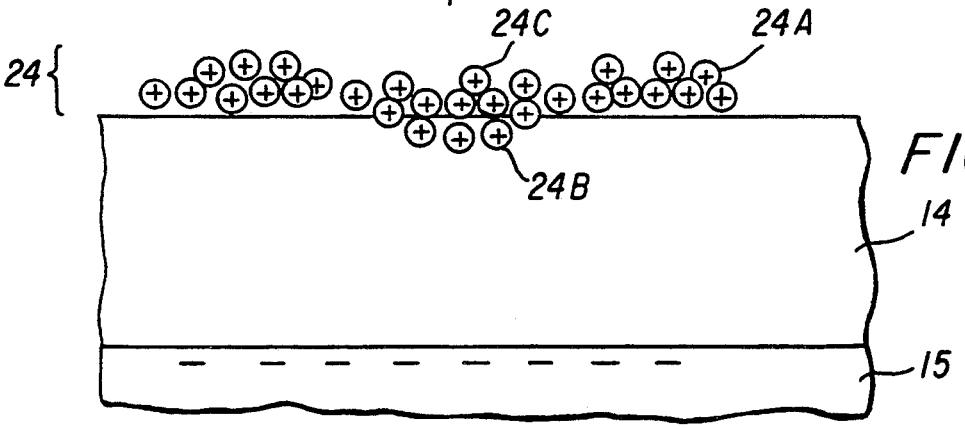
FIGS. 8 and 9 are side sectional views of the exposed portion of the imaging member of FIG. 7 after exposure and cleaning, respectively.
Figure 9:
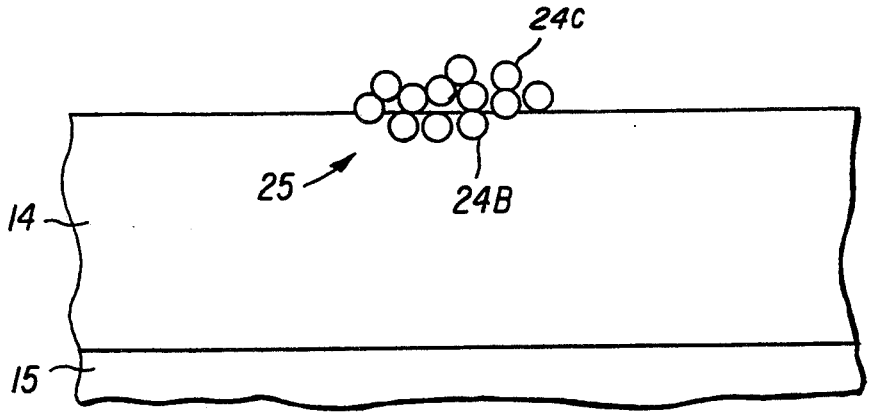

With reference to FIGS. 7, 8, and 9, the marking particle migration will be better understood. Preferably, when achievable, the marking particle layer 24 is a monolayer. However, as shown in FIG. 7, the marking particle layer 24 will in practice be composed of several layers of individual charged marking particles 24A, Each particle 24A is charged so that it is attracted to the grounded electrode layer 16 or support 19 of FIGS. 5 and 6. Accordingly, the particles are attracted to the imaging surface layer 14.

The imaging member 10 is selectively exposed to heat-inducing energy, as may be provided by a laser beam 42A or 42B, in an imagewise pattern. The applied energy will heat selected portions of the imaging surface layer so as to be transformed to a permeable state. Thus, upon localized heating of the imaging surface layer 14, a pixel 25 of the imaging surface layer 14 is transformed. The addressed particles 24A, i.e., those that immediately superpose the pixel 25, migrate into the imaging surface layer 14 due to the aforementioned electrostatic attraction.

The beam scanning rate and intensity are chosen such that the beam moves onward to heat another pixel in the imaging surface layer. If poly-iso-butyl-methacrylate is the imaging surface layer 14, then about 0.10 joules/cm $^2$ of energy is needed to transform the layer to a permeable state. The heat in each pixel 25 soon dissipates, and the pixel 25 returns to a non-permeable state; particle migration stops accordingly. As shown in FIG. 8, the migrated marking particles 24B are either partially or totally embedded in the imaging surface layer.

It is contemplated that a selectable mount of induced heat may cause the addressed particles to melt slightly and thus be tacked together. Upon cooling, the embedded particles 24B and the immediately superposed particles 24C remain cohesive, in contrast to the surrounding particles 24A which are bound to the imaging surface layer only by the electrostatic force. It is further contemplated that a still-higher amount of applied heat may be selected to cause the addressed particles to melt and be partially or wholly mixed with the thermoplastic material in the pixel 25. Such an admixture of marking particles and thermoplastic imaging surface material would be limited to the addressed particles within the volume of the pixel 25. After cleaning, only the addressed particles 24B and 24C remain in or on the imaging surface layer 14.

Modulated laser scanning thereby produces an imagewise pattern of addressed marking particles 24B and 24C. By varying the beam scan rate (exposure duration), the beam pulse intensity, or both, one may select the number of particles in each pixel, the size of the pixel and the marking particle admixture or density in the pixel.

Figure 10:
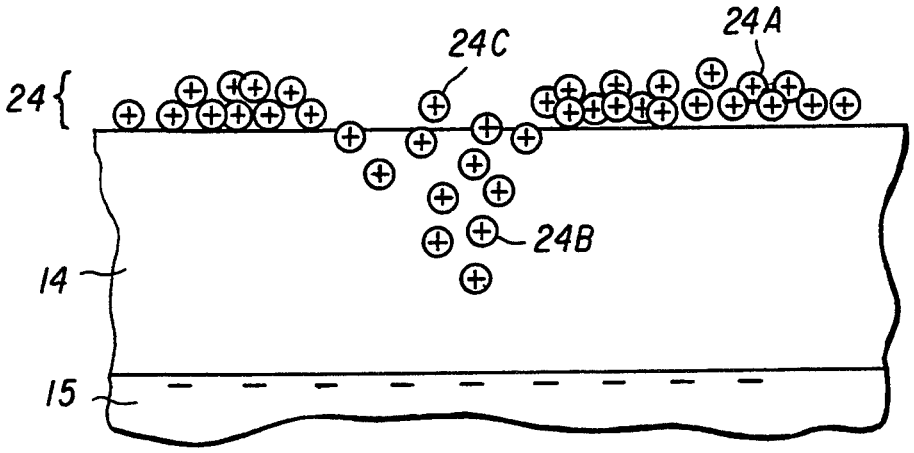
FIGS. 10 and 11 are side sectional views of another exposed portion of the imaging member of FIG. 7 after exposure and cleaning, respectively.
Figure 11:
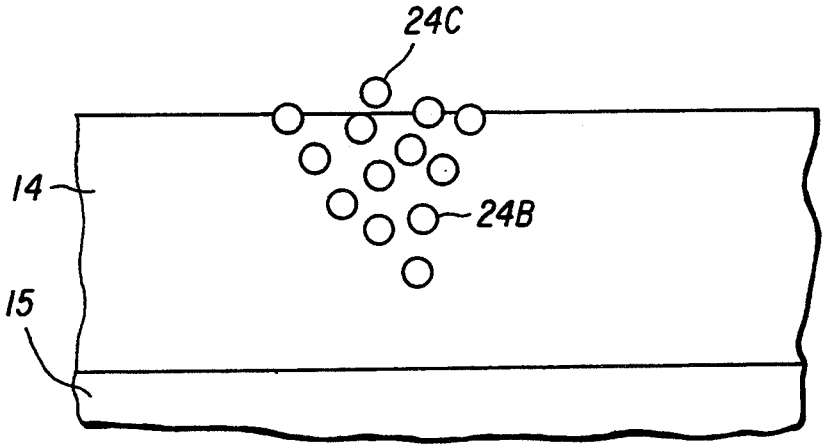

As may be seen in FIGS. 10 and 11, the strength of the electrostatic attraction, or the level of induced permeability, or both, may be sufficient such that the majority of the particles 24C that superpose a pixel 25 become fully embedded in the pixel. Thus, few or none of the overlying particles 24C, as shown in FIG. 11, remain outside the imaging surface layer 14. Any such superposed particles 24C nonetheless resist removal due to cleaning because of their tacky adhesion to the underlying embedded particles.

Figure 12:
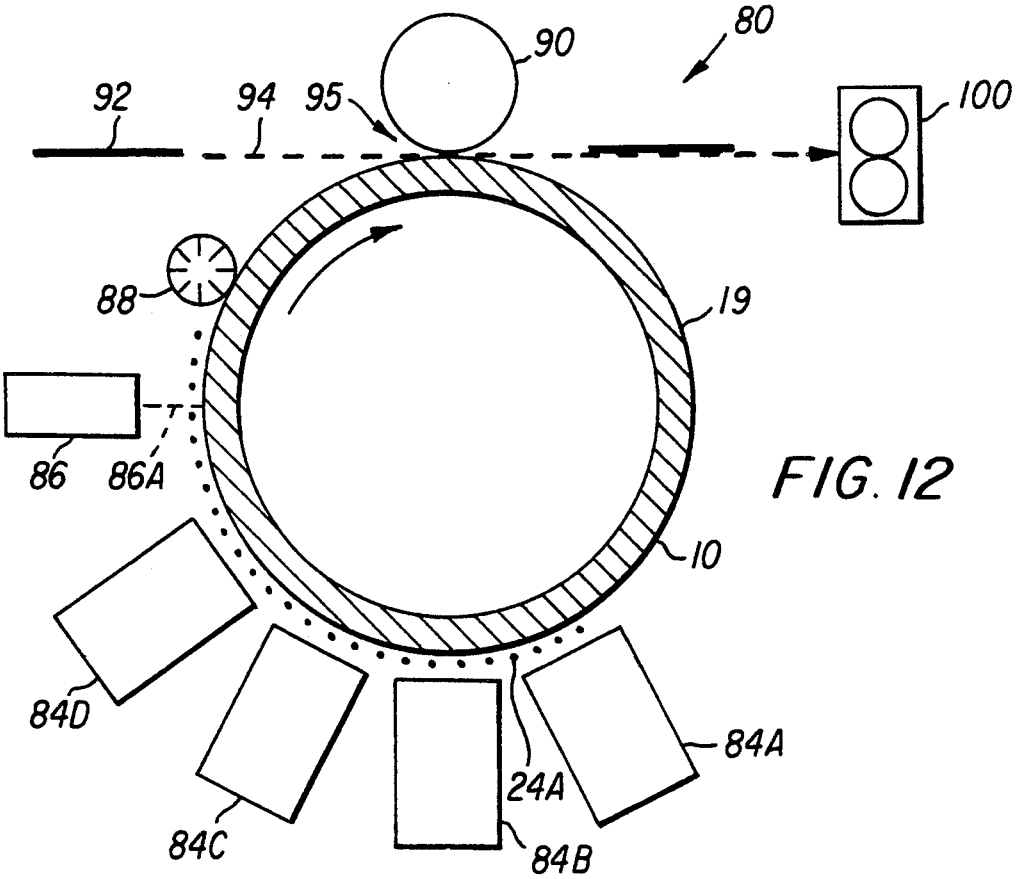
FIG. 12 is a side schematic view of an embodiment of an imaging system usable with the imaging member of FIGS. 5 or 6.

This imaging process is not limited to the creation of a single-color image reproduction by use of only one type of marking particles. The aforementioned steps of marking particle deposition, exposure, and cleaning may be performed cyclically but with marking particles of differing types or colors in each cycle. As illustrated in FIG. 12, a multicolor imaging system 80 includes the imaging member 10 mounted on a support 19. The imaging member 10 uniformly contacts the outer surface of the support drum 19. If the drum is composed of a conductive material, imaging member 10B (which lacks an electrode layer 16) may be used. The image member 10 may be attached at its edges to the support 19 by known clamping means (not shown).

As the support 19 is rotated, an image frame receives a layer of one of a choice of (for example) cyan, magenta, yellow, or black colored marking particles 24A dispensed from one of the respective marking deposition means 84A, 84B, 84C, or 84D. In the addressing step, respective cyan, magenta, yellow, or black image data controls the appropriate scanning exposure by a modulated beam 86A from a laser scanner 86. Then, unaddressed marking particles are cleaned from the image frame by a cleaning means 88. The same image frame is rotated through the cycle of steps again, that is, to receive the next color choice of marking particles to be deposited, etc. For each separation color image in a multicolor composite image, the foregoing cycle is repeated.

The imaging surface layer 14 thereby accumulates a composite color image in one image frame. Without further processing, the imaging member 10 may be removed from the support 19 for use as a color transparency having a composite multicolor image.

The imaging member 10 may remain on the support 19 (which continues to rotate) such that the imaging surface layer 14 may be transferred and bonded to a heated receiver means 90 or to a heated receiver sheet 92. If the transfer is to a receiver sheet 92, a hard copy multicolor print is produced. Multiples of such prints are produced by continuous repetition of the foregoing process.

In a second multicolor process contemplated in the invention, a series of image frames may be prepared on the imaging member 10. The process includes the aforementioned cycle of marking particle deposition, imagewise exposure, and unaddressed particle cleaning of the imaging surface layer. However, each step is performed on not one, but a series of image frames on the imaging member 10. Thus, in the marking deposition step, two or more marking deposition means 84A, 84B, 84C, or 84D deposit a layer of uniform colored marking particles on respective image frames. In the scanning beam exposure step, respective cyan, magenta, yellow, or black image data controls the appropriate exposure of the image frames as they are rotated past the scanner 86. Lastly, unaddressed marking particles from all the image frames are cleaned by a cleaning means 88. The steps may overlap; i.e., the exposure step may begin on the first image frame of deposited marking particles as the second frame of marking particles is being deposited, and so on.

The imaging member 10 or 10A thereby accumulates a series of transferable colored image frames which, when superimposed, will form a composite multicolor image. As before, the imaging member 10 or 10A may be removed for use as a color transparency, or for examination of the sequential color separation images.

Alternatively, the support 19 may be rotated further such that in a series of transfer steps, the image frames are sequentially transferred to respective receiver sheets 92 to form a proof set of color separations. Such a set of hard copy images of differing colors or types of marking particles are suitable for proofing a multicolor image. Thus, a first receiver sheet is guided on path 94 through the nip 95 to receive only the first image frame of addressed marking particles. As the first receiver sheet 92 is passed to a fusing station 100, a second receiver sheet is guided on path 94 into registered engagement with the second image frame, and then to the fusing station. Subsequent imagewise patterns are similarly transferred to additional, respective receiver sheets. A set of fixed imagewise patterns on respective receiver sheets is generated. Multiple proof sets are produced by continuous repetition of the foregoing process.

In still another embodiment, repeated, synchronous rotation of the transfer drum 90 may be used to place one receiver sheet 92 into registered and repeated engagement with successive image frames in the imaging surface layer 14. The receiver sheet 92 then accumulates the transferred image frames in superposition. For example, a receiver sheet 92 may be fed to the nip 95 between a transfer drum 90 and the support 19. The receiver sheet 92 is retained on the rotating transfer drum 90 for engagement with the first, then second, etc. image frames in the imaging surface layer 14. The receiver sheet 92 is then released from the transfer means and guided to an optional fusing station 100 for complete fusing of the composite image, if necessary.

Because either the imaging surface layer 14 alone, or the entire imaging member 10 may be transferred in one of the above-described processes, a new imaging member may be needed on the support 19 to continue the imaging process. It is contemplated, therefore, that the support 19 may be equipped with an imaging member internal feeder or spooling device (not shown). New image members 10 my be spooled from a continuous roll supply within the support 19 and severed from the support 19 when processing is complete. Such a spooling apparatus is known in the art. Alternatively, sheet feeding and attachment means (not shown) are known for feeding and attaching a series of individual imaging members 10 to the support 19. Each imaging member 10 may be fed and positioned by such means on the support 19.

Figure 13:
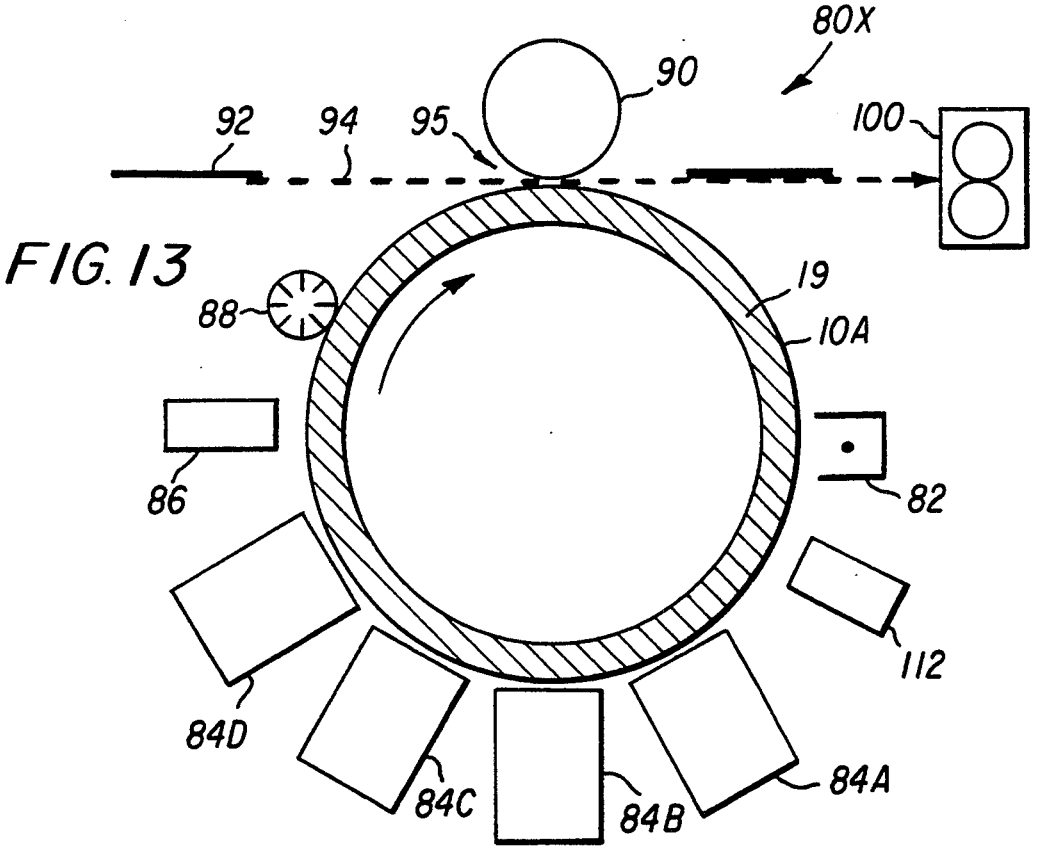
FIG. 13 is a side schematic view of a multicolor imaging system constructed according to the present invention.

With reference again to FIG. 6 and now to FIG. 13, the foregoing processing steps may be appreciated as usable in such a way as to generate a xeroprinting master. Accordingly, the imaging member 10B of FIG. 6, in particular, is specially formulated with known compounds such that either the imaging surface layer 14 or the film base 15A is photoconductive. Formulation of single or multiple layer photoconductor is known in the art. The imaging member 10B is mounted on a combined master-making and xeroprinting system 80X, which is constructed much like the imaging system 80 already discussed with respect to FIG. 12.

In a first, or master-making, mode of the system 80X, the imaging member 10B is first processed on system 80X in the fashion described with respect to system 80 of FIG. 12 to receive an imagewise pattern of marking particles. In this instance, however, the marking particles are especially selected as being light-opaque. The processed imaging member 10B is then transferred to the transfer drum 90 from the support 19. The film base 15A, which in this case is photoconductive, thereby becomes the outer surface of the transfer drum 90.

The transfer drum 90 and imaging member 10B may then be removed and relocated as a unit to a remote xeroprinting system, where the processed imaging member 10A is usable as a xeroprinting master. That is, the imagewise pattern of opaque marking particles in the processed imaging surface layer 14 may be utilized as an exposure mask for selective light exposure of the photoconductive film base 15A. (Alternatively, the processed imaging member 10 may also be removed from the drum 90 and used alone as a master).

Mask-based xeroprinting is known in the art and, therefore, will be related only briefly here. In such a remote xeroprinting system, the film base 15A is first uniformly charged, and light is directed through the areas in the imaging member that are not obscured by the imagewise pattern of thermalized marking particles. The charge on the film base 15A is dissipated by the light exposure not masked by the marking particles, thus leaving a latent image charge pattern for development with an influx of developer. The developed image is then transferred to a receiver and fixed at a fusing station.

The imaging system 80X may also be adapted for xeroprinting. The imaging member 10B may be processed, as described in the above, to become a xeroprinting master having one or more image frames of opaque particles. However, in this application the imaging surface layer 14 is photoconductive and the imaging member 10B is retained on the support 19. With continued rotation, the imaging member 10B is uniformly charged at a charger 82. Light emitted from a light source 112 is blocked from reaching the underlying portions of the imaging surface layer 14 in the areas obscured by marking particles. The charge on the imaging surface layer 14 is lessened or grounded by the light exposure not masked by the marking particles. The imagewise differential in charge constitutes an electrostatic latent image which is developable with colored marking particles. Thus, with further rotation of the support 19, each latent image is developed with marking particles by a respective particle deposition means 84A, 84B, 84C, or 84D.

Each developed image is rotated to meet a receiver sheet 92 fed in synchronism into the nip 95 with the rotation of the support 19. The series of developed images are thus transferred to a respective series of receiver sheets 92 to form a hard copy set of images. If a composite print is desired, only a single receiver would be fed in synchronism into the nip 95 to receive a first developed image. The receiver would be retained on the transfer drum 90 and returned to the nip 95 with the approach of a second developed image, which would be transferred in superposition onto the first developed image to create a composite image. Additional developed image transfers may be made in a similar fashion, whereupon the receiver 92 is passed to the fusing station 100 for fixing the composite image. A large number of high-resolution multicolor prints may, for example, be provided at very high speed in the foregoing process.

The invention has been described in detail with particular reference to preferred embodiments thereof, but it will be understood that variations and modifications can be effected within the spirit and scope of the invention, For example, it is contemplated that other types of particles may be substituted for the marking particles used in the above-described embodiments. Opaque magnetic particles may be advantageously used to provide machine-readable images in the imaging surface layer. Luminescent, radioactive, polarizing, or photoconductive marking particles may be used to create imagewise patterns having respective characteristics in the imaging surface layer. The use of conductive particles is also contemplated for creating electrically-conductive traces, capable of carrying electromagnetic signals, in the imaging surface layer 14.

What is claimed is:

1. A method of migration imaging, comprising the steps of:

depositing a layer of thermoplastic particles on a supporting section of an imaging member, applying heat-inducing energy to the thermoplastic particles to cause them to coalesce and form a thermoplastic imaging surface layer on the supporting section;

cooling the thermoplastic imaging surface layer such that it is impermeable to marking particles;

depositing marking particles on the imaging surface layer;

establishing an electrostatic attraction between the marking particles and the supporting section;

imagewise exposing the imaging member to heat-inducing energy to imagewise transform the imaging surface layer to a state permeable by the marking particles, in the presence of the electrostatic attraction between the marking particles and the supporting section to cause those marking particles contacting the exposed areas of the imaging member to migrate into the imaging surface layer in an imagewise pattern, and removing the marking particles that did not migrate into the imaging surface layer.

* * * * *